US009556867B2

(12) United States Patent
Saga et al.

(10) Patent No.: US 9,556,867 B2
(45) Date of Patent: Jan. 31, 2017

(54) VANE PUMP

(71) Applicant: HITACHI AUTOMOTIVE SYSTEMS, LTD., Hitachinaka-shi, Ibaraki (JP)

(72) Inventors: Koji Saga, Ebina (JP); Hideaki Ohnishi, Atsugi (JP); Yasushi Watanabe, Kanagawa (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 285 days.

(21) Appl. No.: 14/516,938

(22) Filed: Oct. 17, 2014

(65) Prior Publication Data

US 2015/0110659 A1 Apr. 23, 2015

(30) Foreign Application Priority Data

Oct. 21, 2013 (JP) ..... 2013-218028

(51) Int. Cl.
*F01C 20/18* (2006.01)
*F04C 2/344* (2006.01)
(Continued)

(52) U.S. Cl.
CPC ..... *F04C 2/3441* (2013.01); *F04C 2/3442* (2013.01); *F04C 14/223* (2013.01); *F04C 14/226* (2013.01);
(Continued)

(58) Field of Classification Search
CPC ... F01C 21/0836; F01C 14/223; F01C 14/226; F01C 15/0023; F01C 2240/20; F01C 2/3441; F01C 2/3442
See application file for complete search history.

(56) References Cited

U.S. PATENT DOCUMENTS 4,902,209 A 2/1990 Olson
5,030,074 A * 7/1991 Sakamaki ..... F01C 21/0809 384/112
(Continued)

FOREIGN PATENT DOCUMENTS

DE 10 2009 039 776 A1 3/2011
JP 60-102488 U 7/1985

OTHER PUBLICATIONS

U.S. Office Action dated Feb. 12, 2016 issued in U.S. Appl. No. 14/319,597.
Watanabe: Notice of Allowance dated Jul. 11, 2016 as received in corresponding U.S. Appl. No. 14/319,597.
U.S. Appl. No. 14/319,597, filed Jun. 30, 2014, Watanabe.

*Primary Examiner* — Jesse Bogue
(74) *Attorney, Agent, or Firm* — Foley & Lardner LLP

(57) ABSTRACT

A vane pump includes a rotor including a first annular groove and a second annular groove. The rotor further includes a cylindrical portion projecting axially from a radial inner side of the first annular groove and fitting over a drive shaft, and a slide contact portion formed on a radial inner side of the second annular groove. The cylindrical portion is slidably received in a bearing hole formed in a first side wall of a housing, whereas the slide contact portion abuts slidably on an inside wall surface of a second side wall of the housing. There is further formed, in the first annular groove, a recessed portion making a pressure receiving area of one of the first and second annular grooves greater than a pressure receiving area of the other of the first and second annular grooves.

20 Claims, 8 Drawing Sheets

(51) Int. Cl.
*F04C 14/22* (2006.01)
*F04C 15/00* (2006.01)
*F01C 21/08* (2006.01)

(52) U.S. Cl.
CPC ..... *F04C 15/0023* (2013.01); *F01C 21/0836* (2013.01); *F04C 2240/20* (2013.01)

(56) References Cited

U.S. PATENT DOCUMENTS

| | | | | |
|---|---|---|---|---|
| 2008/0308062 | A1 | 12/2008 | Morita et al. | |
| 2010/0028171 | A1 | 2/2010 | Shulver et al. | |
| 2010/0221126 | A1 | 9/2010 | Tanasuca et al. | |
| 2010/0282204 | A1 | 11/2010 | Zwickler et al. | |
| 2011/0123379 | A1* | 5/2011 | Saga | F04C 2/3442 418/26 |
| 2011/0194967 | A1 | 8/2011 | Watanabe et al. | |
| 2012/0051955 | A1* | 3/2012 | Hadar | F04C 2/3442 417/410.3 |
| 2012/0301342 | A1 | 11/2012 | Ohnishi et al. | |
| 2013/0136641 | A1 | 5/2013 | Novi et al. | |
| 2014/0234150 | A1* | 8/2014 | Sugihara | F04C 2/344 418/260 |
| 2015/0240808 | A1* | 8/2015 | Akatsuka | F04C 2/3442 418/23 |
| 2016/0047280 | A1* | 2/2016 | Armenio | F04C 2/3442 184/31 |

* cited by examiner

VANE PUMP

BACKGROUND OF THE INVENTION

The present invention relates to a vane pump for supplying oil to sliding contact portions of an internal combustion engine, a variable valve actuating apparatus or other apparatus.

A vane pump of such a type is disclosed in a patent document: JP S60-102488U. This vane pump is fixed to a front end of a cylinder block of an internal combustion engine. The vane pump includes: a pump housing made up of a housing member and a pump cover closing an open end of the housing member; a rotor received rotatably in the housing and arranged to receive rotational force through a drive shaft from a crank shaft; and a plurality of vanes received, respectively, in slits formed radially in an outer circumferential portion of the rotor and arranged to slide radially in the slits, respectively. The vane pump further includes a cam ring disposed around the rotor with a predetermined eccentricity with respect to the rotor. The forward ends of the vanes are arranged to slide on the inside circumferential surface of the cam ring and to define pumping chambers each varying the volume with rotation of the rotator for pump action.

The drive shaft includes an engaging portion having two flat outside surfaces, and the rotor includes a center engaging hole having two flat inside surface and engaging with the engaging portion of the drive shaft to transmit rotation from the drive shaft to the rotor.

SUMMARY OF THE INVENTION

In the above-mentioned vane pump, there is a possibility of undesired radial shift of the center axis of the rotor from the axis of the drive shaft, and whirling motion of the drive shaft. Therefore, there is provided a slight clearance between the engaging shaft portion of the drive shaft and the engaging hole of the rotor, to prevent interference due to the whirling motion. Moreover, to regulate the center axis of the rotor, the rotor is formed integrally with a cylindrical shaft portion fitting over the drive shaft and fitting, with a minute clearance, in a through hole formed in a side wall of the housing.

On the opposite side to the cylindrical shaft portion, the end surface of the rotor are set, with a side clearance, in sliding contact with the inside wall surface of an opposite side wall of the housing, to perform a sealing function. However, the opposite side wall is formed with a through hole receiving the drive shaft, with a relatively large annular clearance for restraining interference with the outside circumferential surface of the drive shaft.

Therefore, during operation of the vane pump, the annular clearance tends to allow leakage to the outside, of the oil flowing through the side clearance.

Specifically, the rotor of the above-mentioned patent document includes opposite end surfaces formed, respectively, with a pair of annular recesses or grooves for retaining guide rings. The annular groove formed in the end surface of the rotor on the side opposite to the cylindrical portion acts to reduce the radial seal width between the end surface of the rotor and the inside wall surface of the side wall of the housing on the opposite side, and tend to increase the leakage of the oil, resulting in deterioration of the pump efficiency.

It is an object of the present invention to provide a vane pump to improve a sealing function and to reduce oil leakage by pressing the rotor axially to one side.

According to one aspect of the present invention, a rotor includes a cylindrical portion which is formed on a radial inner side of a first annular groove formed in a first end surface of the rotor, and which projects along the drive shaft, and a slide contact portion formed on a radial inner side of a second annular groove formed in a second end surface of the rotor. The outside circumferential surface of the cylindrical portion of the rotor is slidably disposed in an inside circumferential surface of a first through hole of a first side wall of a housing, whereas the slide contact portion of the rotor includes a slide contact surface abutting slidably on an inside wall surface of a second side wall of the housing. A pressure receiving area of one of the first and second annular grooves is set greater than a pressure receiving area of the other of the first and second annular grooves.

DETAILED DESCRIPTION OF THE INVENTION

FIGS. 1~13 are views for explaining embodiments of the present invention. In the illustrated embodiments, the vane pump is a variable displacement vane pump adapted to supply a lubricating oil to various parts of an internal combustion engine for a vehicle, such as sliding contact portions, a variable valve actuating apparatus, and pivot oil jet, and arranged to vary the supply oil quantity in accordance with requirements of the parts.

First Embodiment

Figure 1:
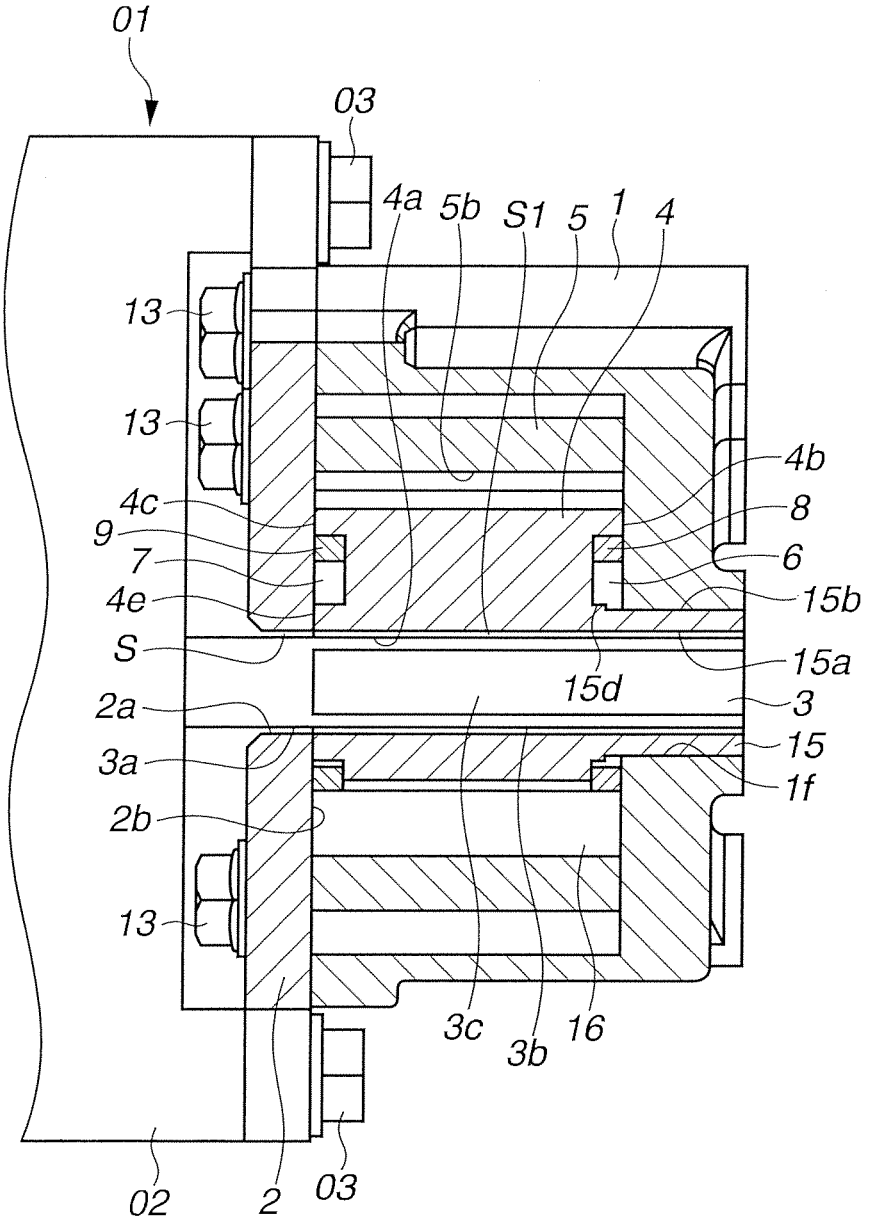
FIG. 1 is a vertical sectional view of a vane pump according to a first embodiment of the present invention.

As shown in FIG. 1. a vane pump according to this embodiment is fixed, by a plurality of bolts 03, to a front end of a balancer housing 02 of a balancer device 01 provided in a lower part of a cylinder block of an internal combustion engine. This vane pump includes a pump housing 04, a drive shaft 3, a rotor 4, and a cam ring 5. The Pump housing 04 includes a housing member or housing main body 1 shaped like a cup having a cylindrical wall and a bottom closing one end, and a pump cover 2 closing the open end of housing member 1. The drive shaft 3 is inserted through center portions of housing member 1 and pump cover 2 into pump housing 04. In this example, drive shaft 3 is extension of a drive shaft of a balancer shaft. The rotor 4 is received rotatably in a container chamber in the pump housing 04, and mounted on the drive shaft 3. Rotor 4 includes an insertion hole 4*a* extending in an axial direction through the rotor. Drive shaft 3 is inserted through the insertion hole 4*a* and engaged with the insertion hole 4*a*. Rotor 4 has a section shaped like a rail. The cam ring 5 is a movable member which surrounds the rotor 4 and which is swingable. The vane pump further includes first and second vane rings 8 and 9 which are slidably disposed, respectively, in first and second annular grooves 6 and 7 formed in axial end surfaces 4*b* and 4*c* of rotor 4 to serve as a pair of guide ring receiving portions.

Figure 4:
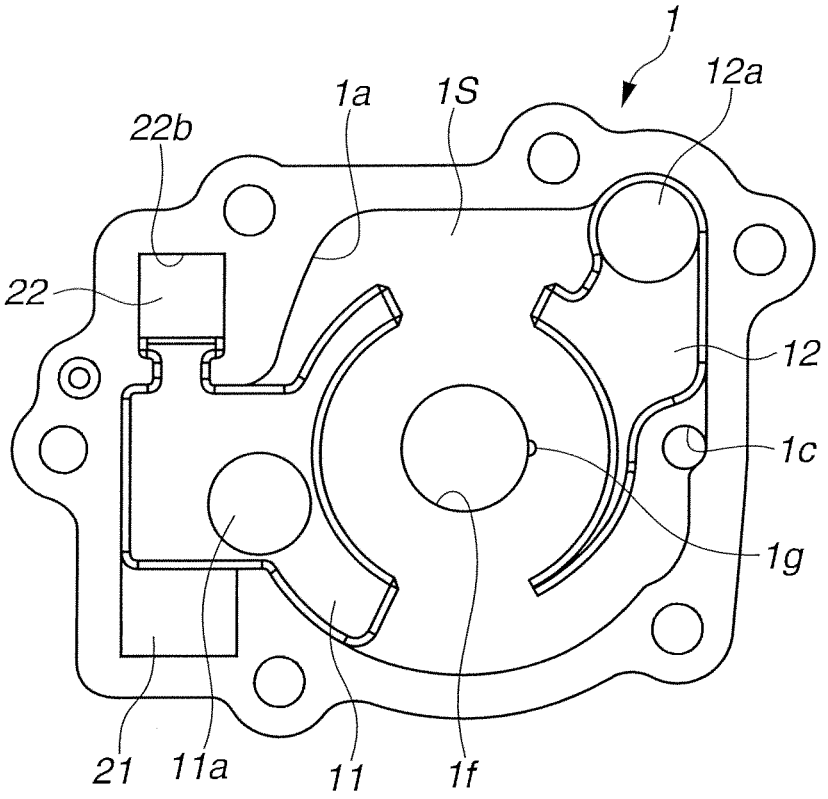
FIG. 4 is a front view of a housing member used in the vane pump of FIG. 1.

The housing member 1 is an integral member of aluminum alloy including a circumferential wall and an end (bottom) wall (which can serve as a first side wall of the housing). An inside bottom surface 1*s* of housing member 1 shown in FIG. 4 is a surface abutting axially on one side surface of cam ring 5, and serving as a sliding contact surface. Therefore, the bottom surface 1*s* is processed to have a higher accuracy in flatness and surface roughness, and includes a sliding contact region which is processed by machining operation.

A pin hole 1*c* is opened in the form of a blind hole, at a predetermined position in the inside circumferential surface of housing member 1. The pin hole 1*c* is arranged to extend axially in the axial direction, and to receive a pivot pin 10 serving as a fulcrum pin defining a fulcrum of swing motion of the cam ring 5. Housing member 1 further includes a seal surface 1*a* on an upper side of an imaginary straight line X (hereinafter referred to as a cam ring reference line) connecting the axis of the pivot pin 10 (or the pin hole 1*c*) and the axis of drive shaft 3 (or the center of the bearing hole 1*f* of housing member 1). The seal surface 1*a* is an inside circumferential surface curved in the form of a circular arc concave surface.

The seal surface 1*a* of housing member 1 confronts a seal surface 5*a* of cam ring 5 through a minute clearance along a circular arc locus around the center defined by pivot pin 10. The seal surface 5*a* is a circular arc convex surface conforming to the circular arc concave shape of seal surface 1*a*. A seal member 14 and a backup member 14*a* are disposed in a seal groove formed in the seal surface 5*a* of cam ring 5. The seal member 14 is urged, by the backup member 14*a* made of rubber, onto the seal surface 1*a*, and arranged to seal a control oil pressure chamber 19. The seal surface 1*a* extends to have an circular arc length to enable the seal member 14 to slide on seal surface 1*a* during a swing motion of cam ring 5 from a state of a maximum eccentricity (cf. FIG. 3) to a state of minimum eccentricity (cf. FIG. 7). Seal member 14 is made of a low friction synthetic resin, for example, and formed to have a long shape extending in the axial direction of cam ring 5.

An intake port 11 is formed in the bottom surface 1*s* of housing member 1, as shown in FIG. 4. Intake port 11 is shaped like a crescent, and formed on a first side (left side in FIG. 4) of the drive shaft 3 (a later-mentioned center bearing hole 1*f* is located between the intake port 11 and the pin hole 1*c*). A discharge port 12 is formed in the bottom surface 1*s* of housing member 1, and shaped like a fan. Discharge port 12 is formed on a second side (right side in FIG. 4) of the drive shaft 3 (the discharge port 12 is located between the center bearing hole 1*f* and the pin hole 1*c*). The intake and discharge ports 11 and 12 confront each other diametrically.

The intake port 11 is in fluid communication with an intake hole 11*a* for receiving the lubricating oil from an oil pan (not shown). The discharge port 12 is in fluid communication with a discharge hole 12*a* for delivering the lubricating oil through a main oil gallery, for example to various sliding contact portions, to a valve timing control apparatus or valve actuation apparatus, and to piston oil jet.

A bearing hole 1*f* is formed approximately at the center of the bottom surface 1*s* of housing member 1. The center bearing hole 1*f* serves as a first through hole through which drive shaft 3 is inserted (with the interposition of a later-mentioned cylindrical portion 15 of rotor 4). A semicircular oil supply groove 1*g* is formed in the inside circumferential surface of center bearing hole 1*f*, and arranged to retain the lubricating oil discharged from the discharge port 12.

Pump cover 2 is fixed directly to the balancer housing 02 by bolts 03 and fixed to the housing member 1, by a plurality of bolts 13, as shown in FIG. 1. The open end of housing member 1 on the left side as viewed in FIG. 1, is closed by pump cover 2 or by an inside wall surface 2*b* of pump cover 2 (which can serve as a second side wall of the housing).

A bearing hole 2*a* is opened at the center of pump cover 2 and arranged to support the drive shaft 3 inserted into the bearing hole 2*a*. Bearing hole 2*a* serves as a second through hole for supporting the drive shaft 3 in cooperation with the first through hole 1*f* of housing member 1. The bearing hole 2*a* is a circular hole having a circular cross section. Drive shaft 3 includes a first shaft portion 3*a* and a second shaft portion 3*b* (or forward end shaft portion). The first shaft portion 3*a* is shaped to have a circular cross section and a cylindrical outside surface, and inserted in the circular bearing hole 2*a* of pump cover 2 with a relatively large annular clearance S. By contrast, the second shaft portion (forward shaft portion) 3*b* is shaped to have a noncircular cross section as mentioned later.

Figure 3:
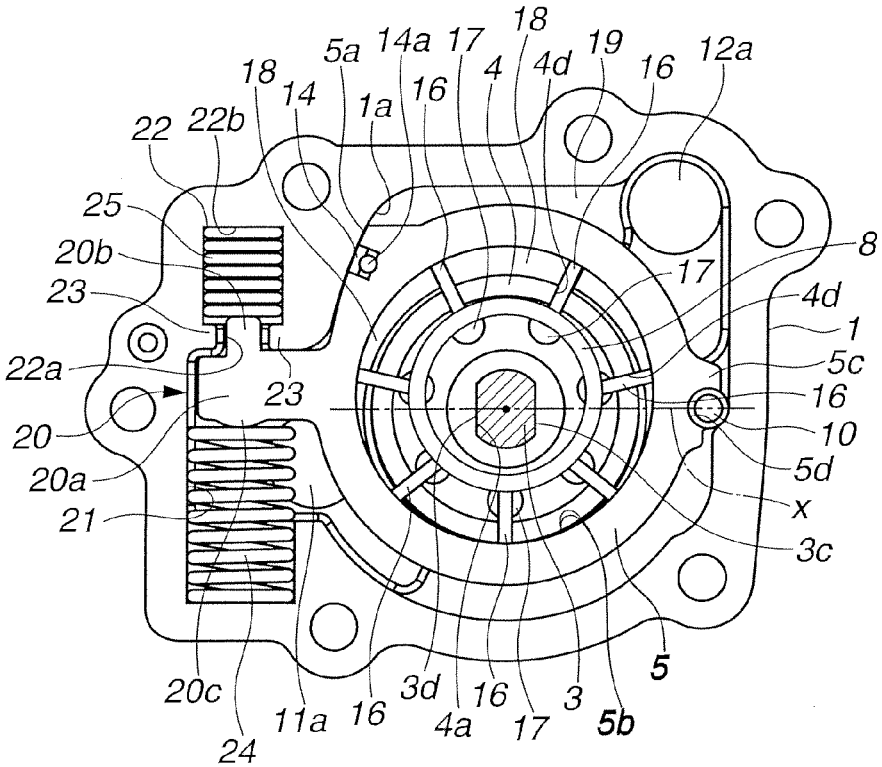
FIG. 3 is a front view showing the vane pump of FIG. 1 in the state in which a pump cover is removed.

The second shaft portion or forward shaft portion 3*b* of drive shaft 3 is inserted in the insertion hole 4*a* of rotor 4, and shaped as an engaging portion having a noncircular cross section. In this example, the forward shaft portion 3*b* has a noncircular cross section defined by two flat side surfaces 3*c* and 3*d* and two curved or arched surfaces as shown in FIG. 3. In this example, the two flat side surfaces 3*c* and 3*d* extend along the axis of drive shaft 3 in parallel to each other and confront each other diametrically to as to define a width across flats. The two arched surfaces are cylindrical surfaces confronting each other diametrically between the two flat surfaces 3*c* and 3*d* so as to form a shape resembling a rectangle.

Drive 3 is adapted to rotate the rotor 4 in the clockwise direction as viewed in FIG. 3, with a rotational force transmitted from the crankshaft to the balancer shaft. An intake region is formed in a left half on the left side of drive shaft 3 in FIG. 3, and a discharge region is formed in a right half on the right side of drive shaft 3.

The rotor 4 has an approximately cylindrical shape, as shown in FIGS. 1~3 and 5, and extends axially from the first end surface 4*b* (facing in a first axial direction or the rightward direction as viewed in FIG. 1), to the second end surface 4*d* (facing in a second axial direction or the left direction as viewed in FIG. 1). The first end surface 4*b* faces axially (in the first axial direction) to the end wall (or bottom) of housing member 1, and contacts slidably with the bottom surface 1*s* of housing member 1 with a minute clearance. The second end surface 4*c* of rotor 4 faces axially (in the second axial direction) to the pump cover 2, and contacts slidably with the inside wall surface 2*b* of pump cover 2 with a minute clearance.

The second end surface 4*c* of rotor 4 includes an annular outer circumferential portion and an annular inner circumferential portion 4*e*. In the second end surface 4*c*, the second annular groove 7 is formed radially between the outer circumferential portion and the inner circumferential portion 4*e*. The inner circumferential portion 4*e* surrounded by the second annular groove 7 is formed as a sliding contract surface of a sliding contact portion contacting slidably with the inside wall surface 2*b* of pump cover 2.

A cylindrical shaft portion 15 is formed integrally in rotor 4. The cylindrical shaft portion 15 is formed radially between the center insertion hole 4*a* and the first annular groove 6 formed in the first end surface 4*b*. The cylindrical shaft portion 15 is formed in an inner circumferential portion of the first end surface 4*b* of rotor 4.

The cylindrical shaft portion 15 projects axially from the first end surface 4*b* of rotor 4, around the outer circumferential surface of drive shaft 3. The cylindrical shaft portion 15 has an inner circumferential surface 15*a* defining an extension of the center insertion hole 4*a*, so as to form a continuous center through hole (4*a*, 15*a*). Cylindrical shaft portion 15 has an outer circumferential surface 15*b* fit rotatably through a minute clearance in the bearing hole 1*f* of housing member 1.

Figure 5:
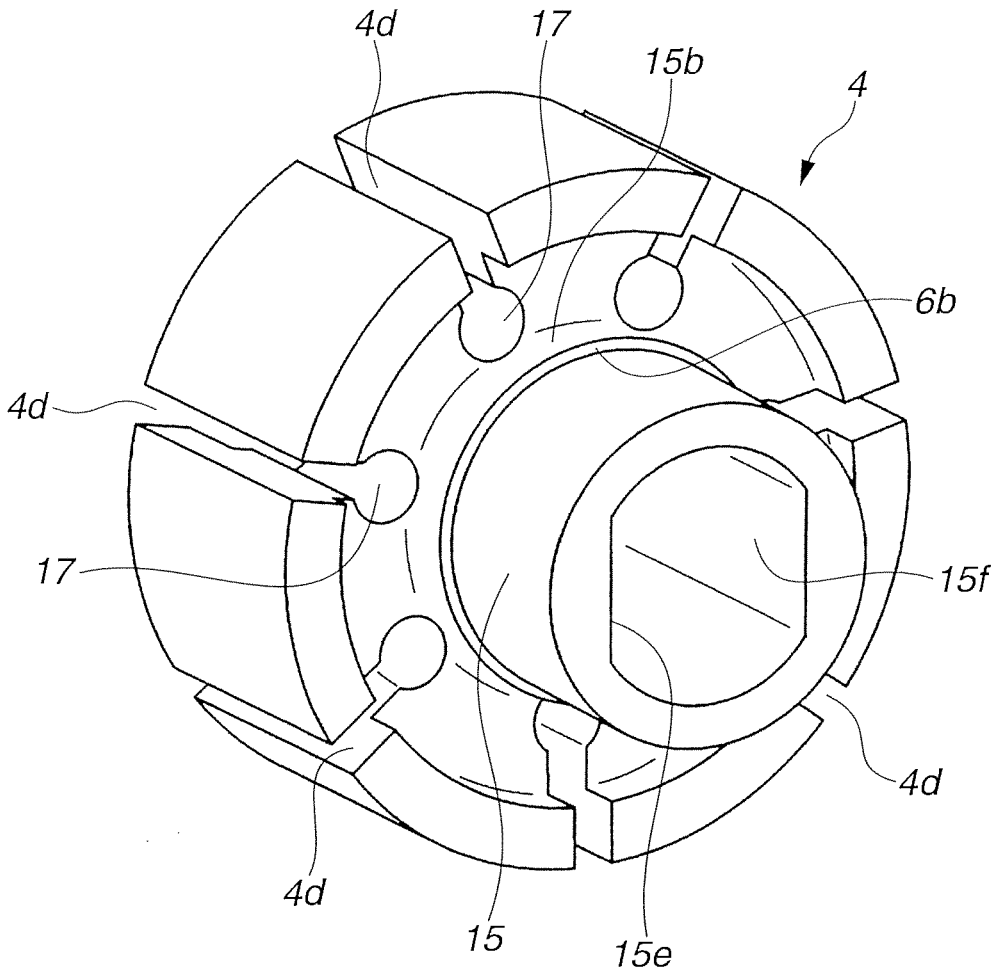
FIG. 5 is a perspective view of a rotor in the vane pump of FIG. 1.

The continuous center through hole (4*a*, 15*a*) has a noncircular cross section corresponding to the noncircular cross section of the forward end portion 3*b* of drive shaft 3 so that the forward end portion 3*b* is fit in the center through hole of rotor 4, and rotor 4 and drive shaft 3 can rotate as a unit. In this example, as shown in FIG. 5. the center through hole is defined by two opposite (parallel) flat side wall surfaces 15*e* and 15*f* confronting each other diametrically, and two cylindrical surfaces confronting each other diametrically between the flat wall surfaces 15*e* and 15*f*. Thus, the forward end portion 3*b* of drive shaft 3 is engaged with the center through hole (4*a*, 15*a*) of rotor 4 so that both rotate as a unit.

Figure 2:
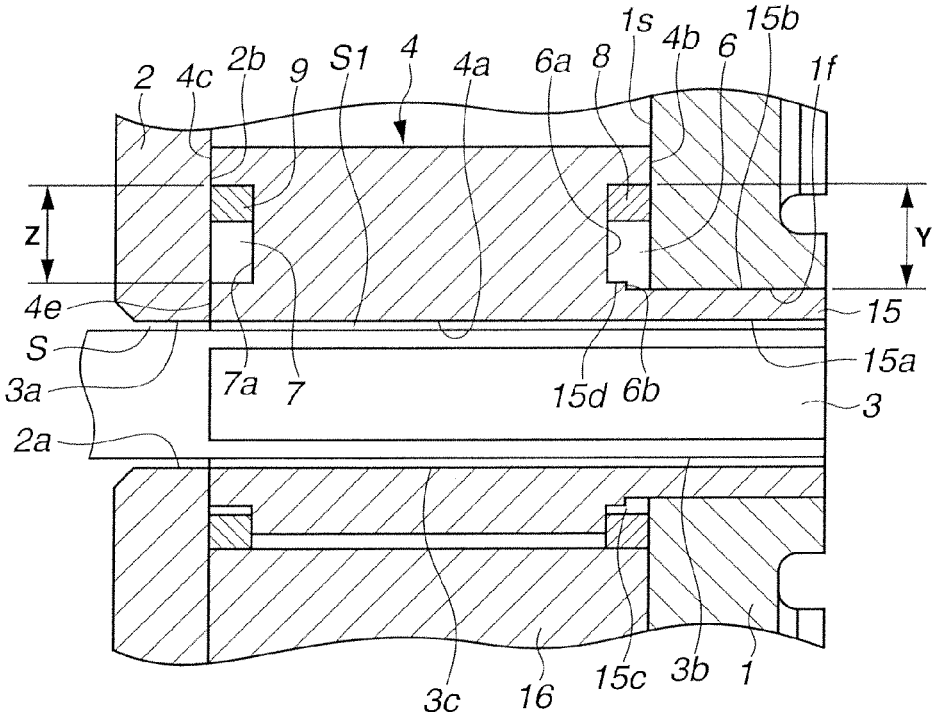
FIG. 2 is an enlarged view of a main portion of FIG. 1.

A clearance S1 having a relatively large size is provided between the outside circumferential surface of forward end portion 3*a* of drive shaft 3 and the inside circumferential surface of the center through hole of rotor 4, as shown in FIGS. 1 and 2.

A step portion 15*d* is formed in the first annular groove 6. The outside circumferential surface 15 of cylindrical shaft portion 15 is formed by operation such as machining and polishing to achieve an accurate surface as the outside surface of a rotating shaft. The step portion 15*d* is formed as a result of the machining operation of forming the outside circumferential surface of the cylindrical shaft portion 15. The first annular groove 6 is defined by a bottom (or end) surface 6*a* and outer and inner circumferential surface confronting each other radially to define the radial width of the annular groove. The bottom surface 6*a* is an annular flat surface in this example, and faces axially (rightwards in FIG. 2) toward the bottom surface 1*s* of housing member 1. The step portion 15*d* is defined by a shoulder surface 6*b* formed between the inner circumferential surface of the first annular groove 6 and the outside circumferential surface 15*a* of the cylindrical shaft portion 15. The shoulder surface 6*b* is a flat annular surface in this example, and faces axially (rightwards in FIG. 2) toward the bottom surface 1*s* of housing member 1. Therefore, this shoulder surface 6*b* serves as an additional pressure receiving surface. The total pressure receiving area of first annular groove 6 is equal to the sum of the area of the proper pressure receiving surface of the bottom surface 6*a*, and the area of the additional pressure receiving surface defined by the shoulder surface 6*b*. Thus, the pressure receiving area of first annular groove 6 is increased by step portion 15*d*.

The second annular groove 7 is also defined by a bottom (or end) surface 7*a* and outer and inner circumferential surface confronting each other radially to define the radial width of the annular groove 7. The radial width Z of the second annular groove 7 is substantially equal to the radial width of first annular groove 6. However, the radial width Y between the outer circumferential surface of first annular groove 6 and the outer circumferential surface of the cylindrical shaft portion 15 is greater than the radial width Z of second annular groove 7, by the radial width of shoulder surface 6*b*. Thus, the total pressure receiving area of the bottom surface 6*a* and the shoulder surface 6*b* is greater than the pressure receiving area defined only by the bottom surface 7*a* of second annular groove 7.

A plurality (seven) of vanes 16 are slidably received, respectively, in a plurality (seven) of radial slits 4*d* formed radially in rotor 4 to extend radially outwards. A back pressure chamber 17 is formed at the radial inner end of each slit 4*d*. In this example, each back pressure chamber 17 has an approximately circular cross section. The back pressure chambers 17 are arranged to receive the discharge oil pressure discharged to discharge port 12.

Each vane 16 includes an inner base end sliding on outer circumferential surfaces of first and second vane rings 8 and 9 and a forward end sliding on an inside circumferential surface 5*b* of the cam ring 5. A plurality of pumping chambers 18 are formed liquid-tightly by the vanes 16, the inside circumferential surface 5*b* of cam ring 5, the outside circumferential surface of rotor 4, the bottom surface 1*s* of housing member 1, and the inside wall surface 2*b* of pump cover 2. Each vane ring 8 or 9 is arranged to push each vane 16 radially outwards.

Cam ring 5 is an integral member shaped like a hollow cylinder, and made of easily-machined sintered metallic material. Cam ring 5 includes a pivot projection 5*c* formed in the outside circumferential surface on the cam ring reference line X at a right outer position as viewed in FIG. 1. At the center of this pivot projection 5*c*, there is formed a pivot groove 5*d* which is recessed in the form of a circular arc, which extends axially, and which is arranged to receive the pivot pin 10 inserted and positioned in pivot hole 1*c*, to determine a fulcrum of eccentric swing motion.

The control oil pressure chamber 19 is formed between the pivot pin 10 for cam ring 5 and the seal member 14 on the upper side of the cam ring reference line X. Control oil pressure chamber 19 is a chamber having an approximately crescent shape defined by the outside circumference surface of cam ring 5, the pivot projection 5*c*, the seal slide contact surface 5*a*, and the seal surface 1*a*. The control oil pressure chamber 19 function to swing the cam ring 5 about pivot pin 10 in the counterclockwise direction in FIG. 3 with the discharge oil pressure introduced from discharge port 12, and thereby to move the cam ring 5 in the direction decreasing the eccentricity or eccentricity quantity with respect to rotor 4.

An arm 20 shown in FIG. 3 is an integral part of cam ring 5. Cam ring 5 includes a hollow cylindrical main portion and the arm 20 projecting from the outside circumferential surface of the hollow cylindrical main portion of cam ring 5, at a position diametrically opposite to the position of pivot projection 5*c*. As shown in FIG. 3, the arm 20 includes an arm main portion 20*a* which projects, in the form of a rectangular plate, radially from the front end of the hollow cylindrical main portion of cam ring 5, to a forward end. Arm 20 further includes a projection or upper projection 20*b* projecting integrally from the upper side of arm main portion 20*a* at a position near the forward end.

Arm 20 further includes a raised portion or lower projection 20*c* projecting integrally in the form of a projection raised in a form like a circular arc from the lower surface of arm main portion 20*a*, at the position opposite to or just below the upper projection 20*b*. The (upper) projection 20*b* projects substantially in a direction (upward direction) perpendicular to a longitudinal direction of the arm main portion 20*a* and includes an upper end curved to have a relatively small radius of curvature.

First and second spring chambers 21 and 22 are formed coaxially on the upper and lower sides of arm 20 on the side opposite to pivot hole 1*c* of pump housing 1. In FIG. 3, the first spring chamber 21 is on the lower side of arm 20, and the second spring chamber 22 is located on the upper side of arm 20 to confront the first spring chamber 21 coaxially across arm 23.

First spring chamber 21 is shaped like a flat rectangular shape extending in an axial direction of housing member 1. Second spring chamber 22 is shorter in the dimension in the up and down direction than first spring chamber 21. Like first spring chamber 21, the second spring chamber 22 is shaped like a flat rectangular shape extending in the axial direction of housing member 1. A lower open end 22*a* of second spring chamber 22 is defined by a pair of retaining portions 23 projecting toward each other in the form resembling a (long) rectangle in the direction of the width of second spring chamber 22. Through the open end 22*a* between the retaining portions 23, the (upper) projection 20*b* of arm 20 can move into and out of the second spring chamber 22. The retaining portions 23 are arranged to regulate a maximum expansion deformation of a later-mentioned second coil spring 25.

A first coil spring 24 is disposed in first spring chamber 21, and arranged to serve as an urging or biasing member for urging the cam ring 5 through arm 20 in the clockwise direction in FIG. 3, that is, in the direction for increasing the eccentric quantity between the rotation center of rotor 4 and the center of the inside circumferential surface of cam ring 5.

First coil spring 24 is provided with a predetermined spring set load W1, and arranged to urge cam ring 5 in the direction increasing the eccentricity with respect to the rotation axis of rotor 4, with an upper end always abutting elastically on the raised portion or lower projection 20*c* formed on the lower side of arm 20. In this way, first coil spring 24 is disposed under compression so as to apply an urging force to cam ring 5 in the clockwise direction.

The second coil spring 25 is disposed in second spring chamber 22, and arranged to serve as an urging or biasing member for urging the cam ring 5 through arm 20 in the counterclockwise direction in FIG. 3.

Second coil spring 25 includes an upper end abutting elastically on an upper inside surface 22*b* of second spring chamber 22, and a lower end abutting elastically on the upper projection 20*b* of arm 20, and thereby urging the cam ring 5 in the counterclockwise direction in FIG. 3, to decrease the eccentricity with respect to the rotation axis of rotor 4 during movement from the maximum eccentricity position of cam ring 5 in the clockwise direction to the position stopped by the retaining portions 23.

Second coil spring 25, too, is endowed with a predetermined spring set load counteracting first coil spring 24. This set load is smaller than the set load of first coil spring 24. Cam ring 5 is set at an initial position (maximum eccentricity position) by the difference between the set loads of first and second coil springs 24 and 25.

In this example, the first coil spring 24 always urges the cam ring 5 in the state provided with the spring set load W1, through arm 20 upwards in the direction to produce the eccentricity, that is, in the direction increasing the volumes of pumping chambers 18. The spring set load W1 is set at a value at which the cam ring 5 starts moving at an oil pressure Pf exceeding a required oil pressure P1 (see FIG. 9) required by the valve timing control (VTC) device.

Figure 6:
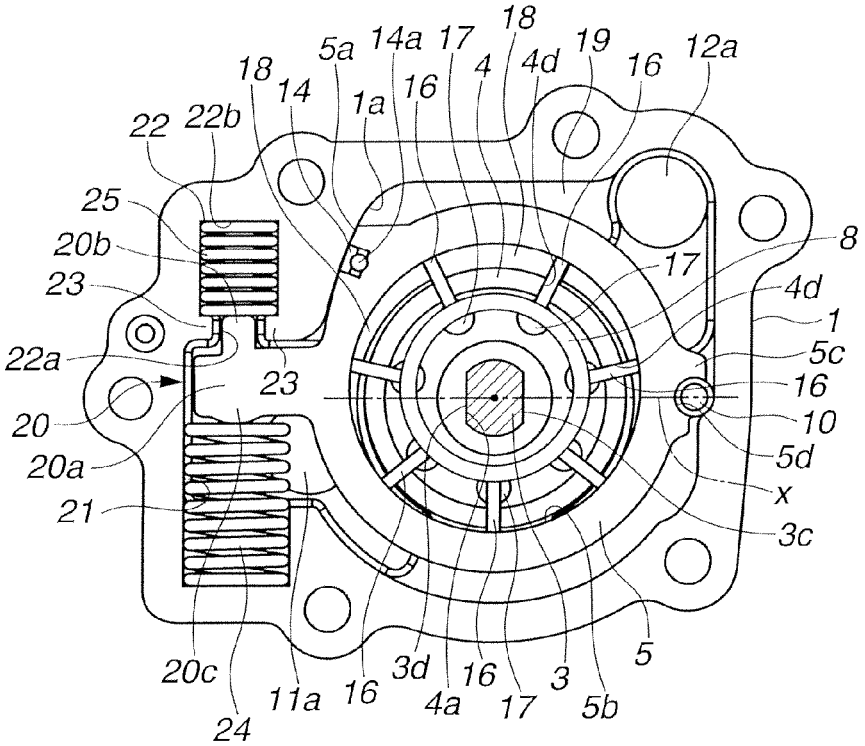
FIG. 6 is a view for illustrating operation of the vane pump of FIG. 1.
Figure 7:
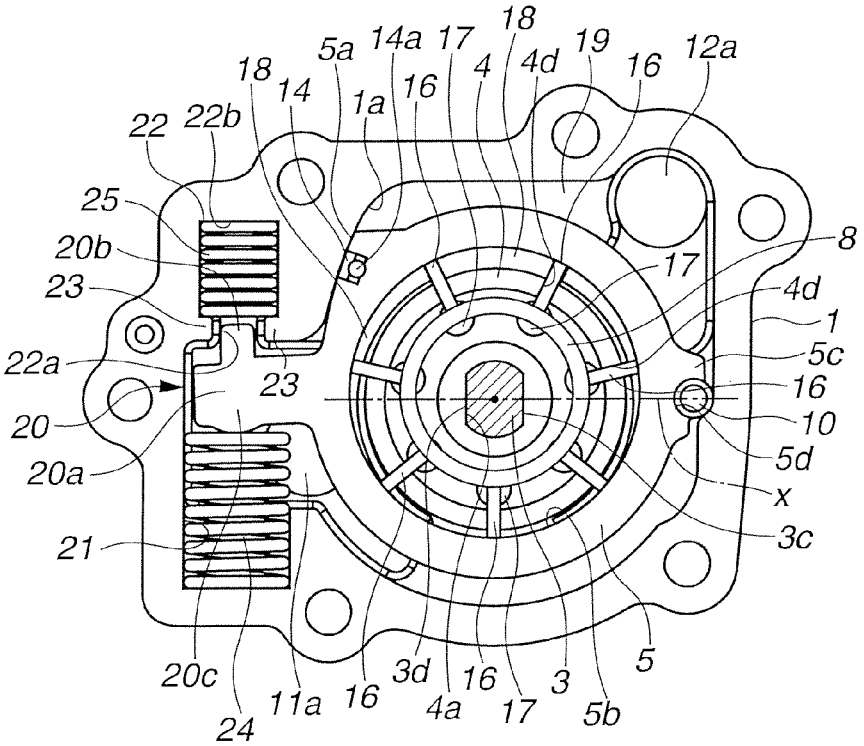
FIG. 7 is a view for illustrating operation of the vane pump of FIG. 1.

On the other hand, the second coil spring 25 is arranged to abut on the arm 20 elastically when the eccentricity of cam ring 5 between the rotation center of rotor 4 and the center of the inside circumferential surface of cam ring 5 is greater than or equal to a predetermined value. However, when the eccentricity of cam ring 5 between the rotation center of rotor 4 and the center of the inside circumferential surface of cam ring 5 becomes smaller than the predetermined value, the second coil spring 25 is held compressed by the retaining portions 23, as shown in FIGS. 6 and 7, and held in a state in which second spring 25 does not touch the arm 20. The spring set load W1 of first coil spring 24 at a swing quantity (a quantity of swing motion) of cam ring 5 at which the load applied on arm 20 by second coil spring 25 is made equal to zero by the retaining portions 23 is a load at which the cam ring 5 starts moving when the oil pressure is equal to a pressure Ps exceeding a required pressure P2 for the oil jet for the pistons, or a required oil pressure P3 required for the bearings of the crank shaft at the time of a maximum crankshaft rotational speed (cf. FIG. 9).

Operation of First Embodiment

Figure 9:
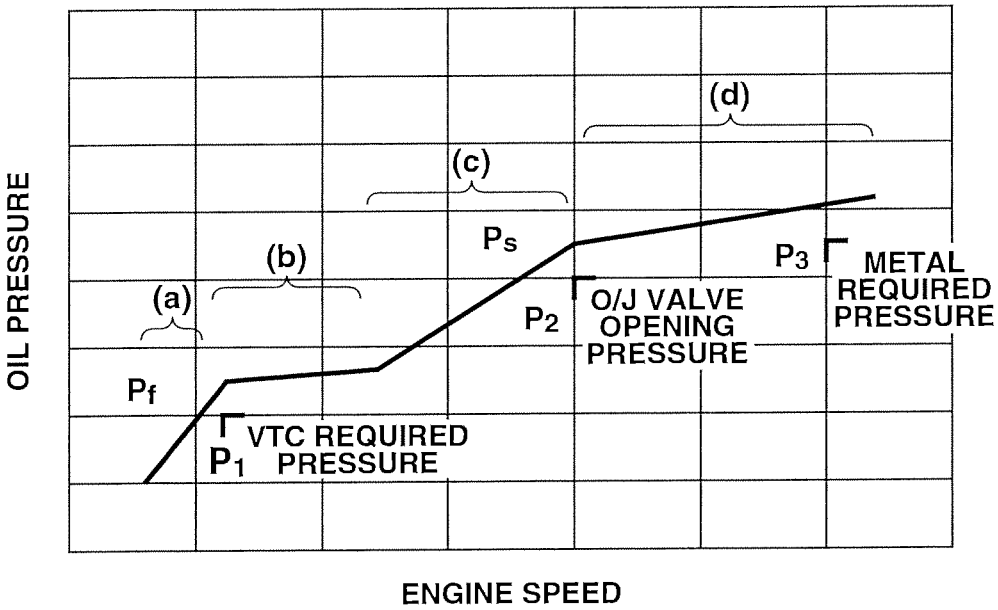
FIG. 9 is a graphic view showing a characteristic representing a relationship between the pump discharge pressure and the engine speed in the vane pump of FIG. 1.

First, FIG. 9 is used for explaining a relationship between the oil pressure controlled by the variable displacement type vane pump according to the first embodiment and oil pressures required for the engine sliding contact portion, the valve timing control device and the piston cooling device.

In the case in which the valve timing control device is used for improving the fuel economy and the exhaust emission, the oil pressure of the above-mentioned oil pump is used for operating the device. Therefore, the required oil pressure for the internal combustion engine is determined by an oil pressure P1 shown in FIG. 9 for improving the operation response of the valve timing control device, from operation in a low engine speed region. In the case in which the oil jet device is used for cooling the pistons, an oil pressure P2 is required in an engine medium speed region. In a high speed region, the required oil pressure is mainly determined by an oil pressure P3 required for lubrication of the bearing portions of the crankshaft. Thus, the oil pressure required by the whole of the internal combustion engine varies as shown by a solid line in FIG. 9.

The required oil pressure P2 in the medium engine speed region is generally lower than the required oil pressure P3 in the high engine speed region (P2<P3), and the required pressures P2 and P3 are close to each other. Therefore, in a region (d) shown in FIG. 9 from the medium speed region to the high speed region, it is desirable to hold the oil pressure unincreased despite of increase of the engine speed.

From a start of the engine to the low speed region, the pump discharge pressure is still lower than P1 as shown in FIG. 9, the arm 20 of cam ring 5 abuts on a stopper surface of housing member 1 by the difference between the spring force of first spring 24 and the spring force of second spring 25, and thereby holds the cam ring in a stop state (cf. FIG. 1).

In this state, the eccentricity of cam ring 5 is greatest, and the discharge volume or capacity of the oil pump is greatest. Therefore, the pump discharge pressure rises steeply with increase in the engine speed, as shown in a region (a) in FIG. 9.

With further increase in the engine speed, the pump discharge pressure further increases and reaches a pressure Pf higher than P1 shown in FIG. 9. In this case, the pressure introduced into control oil pressure chamber 16 becomes high, and the cam ring 5 starts compressing the first coil spring 24 with arm 20, and swings eccentrically in the counterclockwise direction about the pivot pin 10. The pressure Pf is a first operating pressure set higher than the required oil pressure of the valve timing control device.

When the pressure Pf is reached, the pump volume decreases and hence the rate of increase of the discharge oil pressure becomes smaller as shown in a region (b) in FIG. 9. As shown in FIG. 6, the cam ring 5 is swung in the counterclockwise direction until the state in which the second coil spring 25 is held by the retaining portions 23 in a compressed state, and the load of second coil spring 25 is not applied to the upper surface of the upper projection 20*b* of arm 20.

From the state of FIG. 6, the cam ring 5 does not receive the spring force from second coil spring 25, and remains in a held state unable to swing, until the discharge pressure reaches P2 (the oil pressure P2 in the control oil chamber 19) and overcomes the spring load of first coil spring 24. Therefore, with increase in the engine speed, the pump discharge pressure increases as shown by a characteristic in a region (c) in FIG. 9, up to a pressure Ps. In this region (c), the rise of the oil pressure is not so steep as in the region (a) because the eccentricity of cam ring 5 is smaller and the pump volume is smaller in the region (c).

When the engine speed further increases and the pump discharge pressure exceeds Ps, the cam ring 5 swings and compresses the first coil spring 24 against the spring force (W1) of first coil spring 24 with arm 20. With this swing motion of cam ring 5, the pump volume is further decreased, and the rise of the oil pressure becomes more gradual, as shown in a region (d) in FIG. 9. Thus, the oil pressure increases gradually in the region (d) until the engine speed reaches a highest speed.

Accordingly, it is possible to make the pump discharge pressure closer to the required pressure at the time of pump high speed rotation, and hence it is possible to restrain the driving power loss effectively without increasing the oil pressure excessively.

Figure 8:
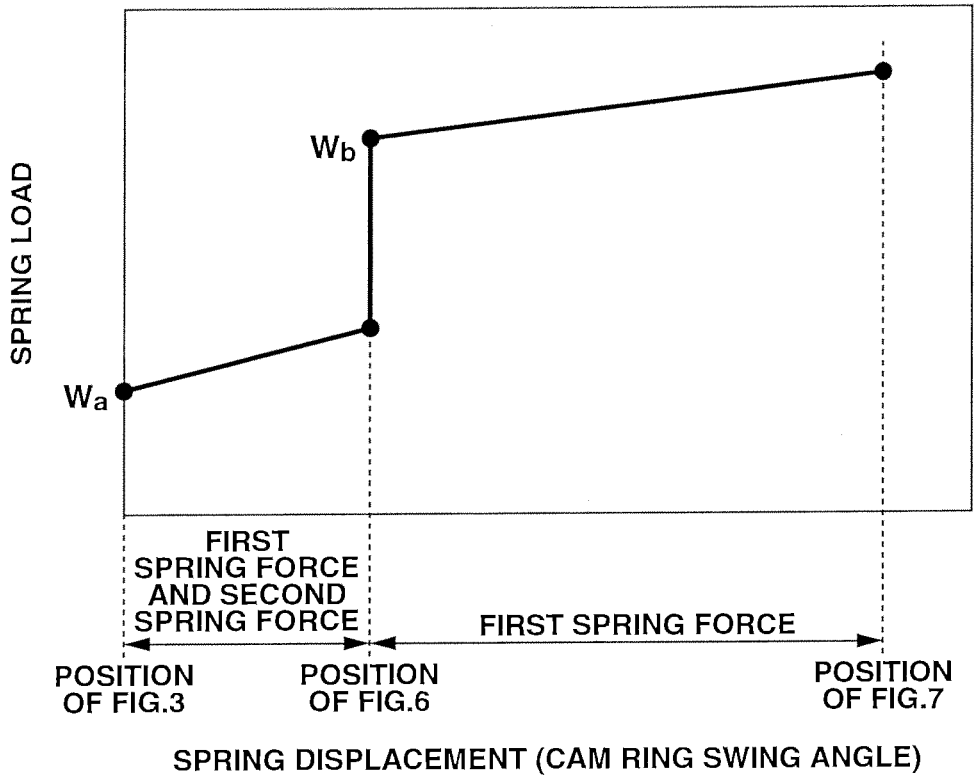
FIG. 8 is a graphic view showing a characteristic representing a relationship between displacements of first and second coil springs and a spring load in the vane pump of FIG. 1.

FIG. 8 shows a relationship between the displacements of first and second coil springs 24 and 25 or the angular displacement of cam ring 5 and the spring loads W1 and W2 of first and second coil springs 24 and 25. In the initial state from a start of the internal combustion engine to a low engine speed region, the spring set load Wa of the coil springs 24 and 25 is provided, and therefore the cam ring 5 is unable to swing until Wa is exceeded. When Wa is exceeded, the first coil spring 24 increases its spring load by being compressed and the second coil spring 25 approaches its free length and decreases its spring load. As a result, the spring load increases. The slope of the spring load corresponds to a spring constant.

At the position of cam ring 5 shown in FIG. 6, the spring force is increased discontinuously or abruptly to a load Wb determined only by first coil spring 24. When the discharge pressure exceeds the level of spring load Wb, the first coil spring 24 is compressed and the spring load is increased. However, the spring force is determined only by one coil spring. Therefore, the spring constant is decreased, and the slope is varied.

In this way, when the discharge oil pressure is increased to Pf by an increase of the engine speed, the cam ring 5 starts moving and restrains an increase of the discharge oil pressure. When cam ring 5 is swung in the counterclockwise direction by a predetermined angle shown in FIG. 6, the spring force of second coil spring 25 is eliminated and the spring constant is decreased. Moreover, the spring load is increased discontinuously. Therefore, the cam ring starts a swing motion again after the discharge pressure is increased to Ps. Thus, the first and second coil spring 24 and 25 are arranged to vary the spring characteristic is varied nonlinearly and cause a special swing motion of cam ring 5.

In this embodiment, the pump discharge pressure is varied nonlinearly as shown in regions (a)~(d) in FIG. 9, by the nonlinear characteristic of the spring force of first and second coil spring 24 and 25. Therefore, the control oil pressure can be made closer to the characteristic of the required oil, and the pump can reduce the power loss due to useless pressure increase.

Moreover, in this embodiment, the pump employs the first and second coil springs 24 and 25 arranged to confront each other. Therefore, it is possible to set the loads of springs 24 and 25 properly in accordance with variation of the discharge pressure, to achieve the optimum spring force for the discharge pressure.

Furthermore, in the vane pump according to this embodiment, the first end surface 4*b* of rotor 4 slides, with a minute clearance (side clearance), on the first side surface formed by the bottom surface 1*s* of housing member 1, and the second end surface 4*c* of rotor 4 slides, with a minute clearance (side clearance), on the second side surface formed by the inside wall surface 2*b* of pump cover 2. With this arrangement, the pump has a function to seal the discharge port 12 and intake port 11 and the first and second annular grooves 7 and 6.

Specifically, each annular groove 6 or 7 is defined radially between an inner circumferential (or cylindrical) wall, and an outer circumferential (or cylindrical) wall which surrounds the inner circumferential wall, and which projects axially to an end forming at least part of the end surface 4*b* or 4*c*, and sliding on the confronting inside wall surface of (1*s*, 2*b*) of the housing member 1 or pump cover 2.

On the second side (left side in FIGS. 1 and 2), the inner circumferential (or cylindrical) wall on the radial inner side of second annular groove 7 projects axially to the slide contact surface 4*e* forming a part of the second end surface 4*c* and sliding on the confronting inside wall surface 2*b* of pump cover 2 to seal the second annular groove 7 from the outside of the pump.

On the first side (right side in FIGS. 1 and 2), the cylindrical shaft portion 15 on the radial inner side of first annular groove 6 projects axially beyond the first end surface 4*b*, and fits in the bearing hole 1*f* of housing member 1 in such a manner to seal the first annular groove 6 from the outside of the pump, with the outside circumferential surface 15*b* of cylindrical shaft portion 15 fitting in the inside circumferential surface of bearing hole 1*f* with a minute clearance. The seal surface formed by cylindrical shaft portion 15 extends long axially, and therefore the sealing performance is good on the first side (right side).

On the second side (left side in FIGS. 1 and 2), the area of the sealing between the slide contact surface 4*e* of rotor 4 and the inside wall surface 2*b* of pump cover is smaller. Moreover, there is formed the relatively large annular clearance S between the inside circumferential surface of bearing through hole 2*a* and the outside circumferential surface 3*a* of drive 3. Therefore, the sealing performance on the second side tends to be poorer.

Therefore, in this embodiment, the pressure receiving area (Y) determined by the bottom surface 6*a* of first annular groove 6 and the shoulder surface 6*b* of the step portion 15*d* is made greater than the pressure receiving area (Z) of the bottom surface 7*a* of second annular groove 7. As a result, the rotor 4 is pressed (leftwards in FIGS. 1 and 2) toward pump cover 2, and thereby the sealing performance is improved between the slide contact surface 4*e* of rotor 4 and the inside wall surface 2*b* of pump cover 2.

First and second annular grooves 6 and 7 face the radial inner portion of each slit 4*d*, so that the oil pressures in first and second annular grooves 6 and 7 tend to be equal to each other. However, the force applied to the rotor 4 by the oil pressure in first annular groove 6 having the larger pressure receiving area is greater than the force applied by the oil pressure in second annular groove 7. Consequently, there is formed a thrust force urging the rotor 4 toward pump cover 2 (leftwards in FIGS. 1 and 2), and hence the rotor 4 is pressed toward pump cover 2. Thus, the second end surface 4*c* of rotor 4 including the slide contact surface 4*e* is pressed on the inside wall surface 2*b* of pump cover 2, and the sealing performance is improved on the second side to restrain leakage of the oil from second annular groove 7 through the annular clearance between the second bearing hole 2*a* and the outside circumferential surface of drive shaft 3.

On the first side, the cylindrical shaft portion 15 is fit in the bearing hole 1*f* with the minute clearance and arranged to seal over the axial length. Therefore, the sealing performance on the first side is not influenced by the action of pressing rotor 4 toward pump cover 2. In this way, the vane pump according to this embodiment can reduce the leakage of the oil, improve the pump efficiency and avoid problem of mixing of air.

In the illustrated example, the drive shaft 3 is held by the drive shaft of the balancer device, and the oil pump is fixed to the end surface of the balancer housing 02. Accordingly, the axis of the drive shaft 3 might be shifted radially from the center of the pump. Moreover, in the case of a conventional vane pump having a rotor formed with no cylindrical shaft portion, the shift of the axis of the drive shaft from the center of the pump changes the eccentricity and changes the pump volume from a design value. Furthermore, the drive shaft might change the eccentricity and the discharge quantity with whirling motion, and thereby increase discharge pulsation.

By contrast, the rotor 4 of the vane pump according to this embodiment is formed integrally with the cylindrical shaft portion 15, and this cylindrical shaft portion 15 of rotor 4 is supported rotatably by the bearing hole 1*f* of housing member 1 in a manner to prevent shift of the axis of rotor 4 from the center of the pump. Therefore, the vane pump can prevent undesired change of the eccentricity and set the pump volume at a design value.

Between the inside circumferential surface of insertion hole 4*a* of rotor 4 (including the inside circumferential surface 15*a* of cylindrical shaft portion 15) and the outside circumferential surface 3*c* of drive shaft 3, there is provided the sufficient clearance S1. Therefore, even if the axis of drive shaft 3 is shifted radially or rotates with whirling motion, this vane pump can restrain interference at a position other than the position between the outside circumferential surface 3*c* of drive shaft 3 and the inside circumferential surface of rotor 4.

Drive shaft 3 is extended axially to have an axial length longer than or equal to the sum of the axial dimension of the main portion of rotor 4 and the axial length of cylindrical shaft portion 15. Therefore, the surface pressure is decreased between the outside circumferential surface 3*c* of drive shaft 3 and the inside circumferential surface of insertion hole 4*a*. Therefore, the durability is secured even when the axial length of rotor 4 is small as in the case in which the drive haft 3 is short or the drive shaft is driven by the crankshaft.

Second Embodiment

Figure 10:
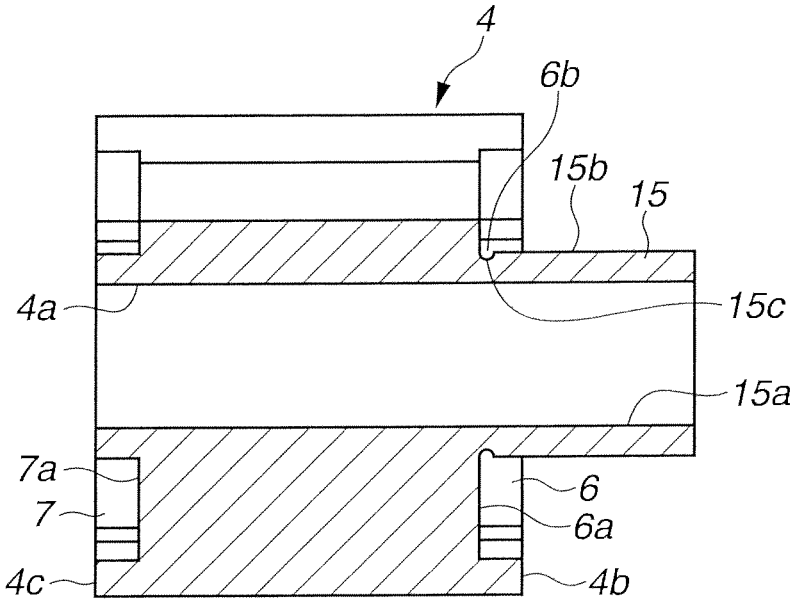
FIG. 10 is a vertical sectional view showing a rotor of a vane pump according to a second embodiment of the present invention.

FIG. 10 shows a rotor 4 according to a second embodiment. Rotor 4 of this embodiment includes an annular clearance groove (or undercut) 15*c*. In the example of FIG. 10, the clearance groove 15*c* is formed at the base end of the cylindrical portion 15, and the clearance groove 15*c* is adjacent to the bottom surface 6*b* of first annular groove 6, so that the clearance groove 15 is bounded, on one axial side, by bottom surface 6*b*. The cylindrical shaft portion 15 extends deep into the first annular groove 6, to the clearance groove 15*c*. Therefore, the machined outside circumferential surface of cylindrical shaft portion 15 extends axially deep into first annular groove 6, up to the clearance groove 15*c*, and there is no step portion. In this way, the clearance groove 15*c* serves as a recessed portion recessed radially inwards to increase the pressure receiving area of the bottom surface 6*a* of first annular groove 6. Accordingly, the second embodiment can provide the same effects as the first embodiment.

Third Embodiment

Figure 11:
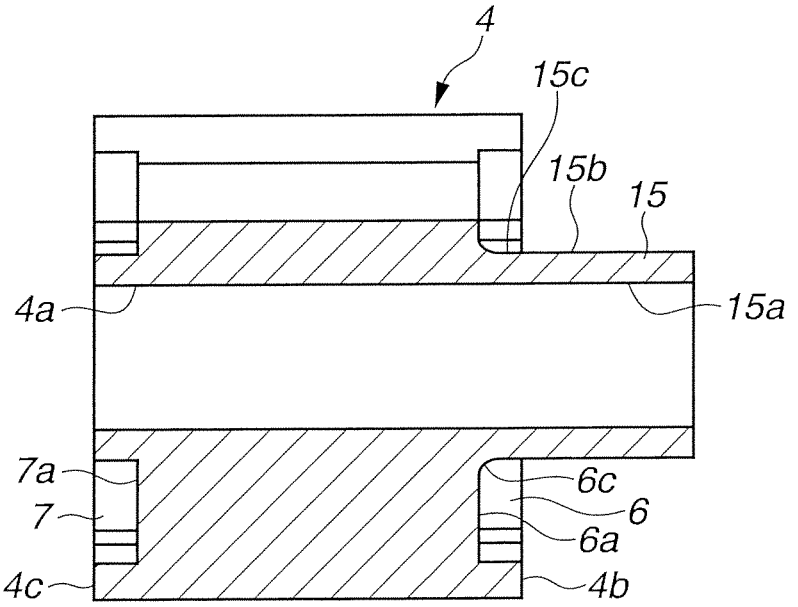
FIG. 11 is a vertical sectional view showing a rotor of a vane pump according to a third embodiment of the present invention.

FIG. 11 shows a rotor 4 according to a third embodiment. Rotor 4 of this embodiment includes an end surface 6*c* formed at the base end of the cylindrical portion 15, continuously with the outside circumferential surface 15*b* of cylindrical portion 15, so as to increase the pressure receiving area of the bottom surface 6*a* of first annular groove 6. In the example of FIG. 11, the end surface 6*c* is a surface forming a corner (inside corner or reentrant corner) formed between the bottom surface 6*a* of first annular groove 6, and the outside circumferential surface 15*b* of cylindrical portion 15. The corner may be an angled corner or a rounded corner. In the example of FIG. 11, the end surface 6*c* is a surface of the rounded corner. In this way, end surface 6*c* serves as a recessed portion recessed radially inwards to increase the pressure receiving area of the bottom surface 6*a* of first annular groove 6. Accordingly, the third embodiment can provide the same effects as the first embodiment. Moreover, in the third embodiment, in the case of forming the rotor of sintered metal, by die forming, it is possible to make easier removal from a die or mold, and thereby to improve the efficiency of the forming operation.

Fourth Embodiment

Figure 12:
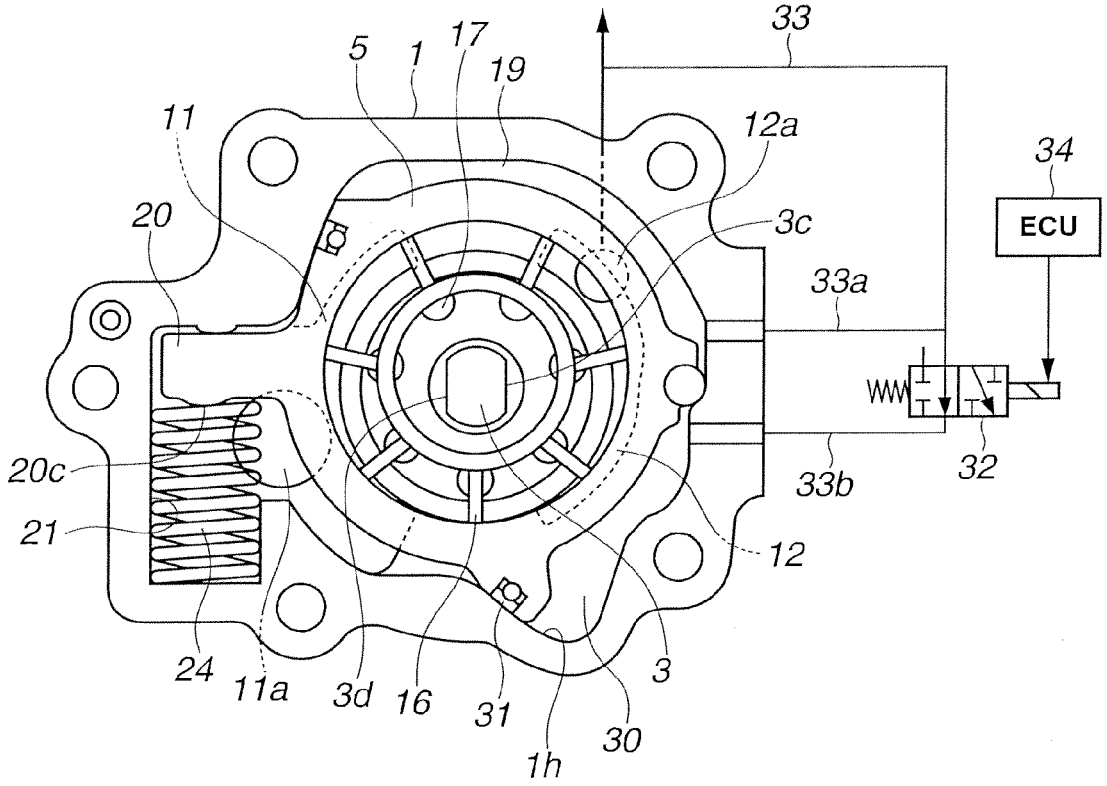
FIG. 12 is a front view of a vane pump according to a fourth embodiment in a state in which a pump cover is removed.
Figure 13:
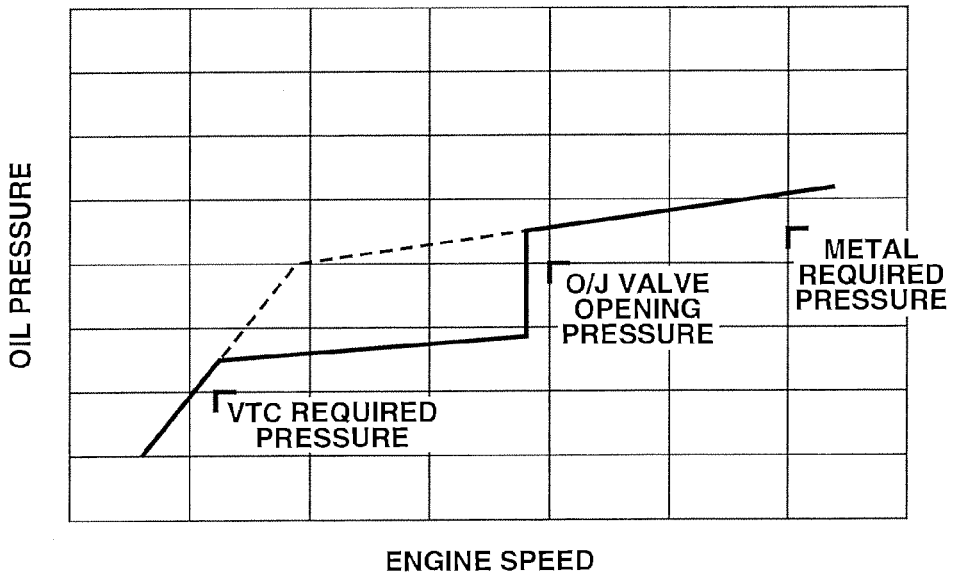
FIG. 13 is a graphic view showing a characteristic representing a relationship between the pump discharge pressure and the engine speed in the vane pump of FIG. 12.

FIGS. 12 and 13 are views for illustrating a vane pump according to a fourth embodiment. The rotor 4 of this vane pump is the same in construction as the rotor 4 of the first embodiment. Unlike the first embodiment, the urging mechanism includes only the first coil spring 24 for urging the cam ring 5 in the direction to increase the eccentricity (the second coil spring 25 is eliminated), and there is provided, on a side opposite to the control pressure chamber 19 with respect to the pivot pin 10, a second control pressure chamber 30 for hydraulically assisting the spring force of first coil spring 24 in the direction to increase the eccentricity.

The second control pressure chamber 30 is sealed liquid-tightly by a second seal surface 1*h* formed in the inside surface of housing member 1, and a second seal member 31 sliding on the second seal surface 1*h*. Second control pressure chamber 30 is connected through a solenoid selector valve 32 with a branch passage 33 on a downstream side of the discharge opening 12*a*. The solenoid selector valve 32 controls the supply and drain of the oil pressure from the branch passage 33, together with the first control pressure chamber 19. A pressure receiving area of second control pressure chamber 30 is smaller than a pressure receiving area of first control pressure chamber 19.

A control unit 34 controls the solenoid selector valve 32 in accordance with one or more parameters such as engine oil temperature, water temperature, engine speed, and load, to change connection among a fluid passage 33*a* leading to the first control pressure chamber 19, a fluid passage 33*b* leading to second control pressure chamber 30, and a drain passage. Thus, the fourth embodiment can provide effects and operations similar to those of the first embodiment, and provide a stepwise oil pressure characteristic with respect to the engine speed, as shown in FIG. 13.

The present invention is not limited to the illustrated embodiments. Various variations and modifications are possible. For example, the set loads of first and second coil springs 24 and 25 can be determined freely in dependence on the specifications of the pump and the size of the pump. Moreover, the coil diameter and coil length can be determined freely. The vane pump according to the present invention can be used for various hydraulic devices other than the internal combustion engine.

A vane pump according to illustrated embodiments has a basic structure of a housing, a drive shaft, a rotor and a plurality of vanes. The housing includes first and second side walls confronting each other axially. The drive shaft is supported rotatably by first and second bearing holes (which may be through holes) formed, respectively, in the first and second side walls of the housing. The rotor is mounted on the drive shaft and adapted to be driven or rotated by the drive shaft. The plurality of vanes are received, respectively, in a plurality of slits formed radially in the rotor and arranged to slide radially in the slits, respectively. The vane pump according to the illustrated embodiment may have any one or more of the following features (z1)~(z24).

(z1) The rotor includes a first end surface confronting the first side wall of the housing (and preferably facing in a first axial direction), and a second end surface confronting the second side wall of the housing (and preferably facing in a second axial direction opposite to the first axial direction). The rotor further includes a first guide ring receiving portion formed in the first end surface, and a second guide ring receiving portion formed in the secondend surface. Preferably, each of the first and second guide ring receiving portions is in the forms of an annular groove. First and second guide rings are received, respectively, in the first and second guide ring receiving portions (annular grooves) and arranged to push the vanes radially outwards in the slits in accordance with rotation of the rotor.

(z2) The rotor includes a cylindrical (shaft) portion projecting axially (in the first axial direction (rightwards in FIG. 1)) from the first end surface, on a radial inner side of the first annular groove, and fitting over the drive shaft; and a slide contact portion surrounded by the second annular groove in the second end surface of the rotor. (z3) The cylindrical portion of the rotor (or an outside circumferential surface of the cylindrical portion) is slidably received in the first bearing (through) hole of the first side wall of the housing, whereas the slide contact portion of the rotor abuts slidably on an inside wall surface of the second side wall of the housing. (z4) The first bearing hole of the first side wall of the housing is greater in inside diameter than the second bearing hole of the second side wall of the housing. (z5) The first bearing hole of the first side wall of the housing is sized to receive the cylindrical portion of the rotor fitting over the drive shaft, and the second bearing hole of the second side wall of the housing is sized to receive only the drive shaft. (z6) The first guide ring receiving portion (first annular groove) of the rotor includes a recessed portion recessed radially inwards (so as to increase a pressure receiving area of the first guide ring receiving portion). The recessed portion may be one of a portion forming a step portion (15*d*), a clearance groove (15*c*) and a corner (6*c*). (z7) The first guide ring receiving portion (first annular groove) includes a bottom surface (confronting surface or pressure receiving surface) facing toward the first side wall (rightwards in FIG. 1, in the first axial direction), an outer circumferential surface facing radially inwards, and an inner circumferential surface which faces radially outwards toward the outer circumferential surface and which includes a recessed portion recessed radially inwards (so as to increase a pressure receiving area of the first guide ring receiving portion as compared to a pressure receiving area of the second guide ring receiving portion).

(z8) The rotor includes a step portion formed between an inner circumferential surface of the first annular groove and an outside circumferential surface of the cylindrical portion, and arranged to increase the pressure receiving area of the first annular groove. In this case, the step portion can be formed simultaneously at the time of forming the outside circumferential surface of the cylindrical portion. (z9) The step portion is formed by a first (smaller diameter) portion which is equal in diameter to the outside circumferential surface of the cylindrical portion and a second (larger diameter) portion which forms the inner circumferential surface of the first annular groove and which is connected with the first portion in a form of a step. The second portion can be formed simultaneously at the time of forming the first annular groove, and the step portion can be formed only by forming the first portion by cutting operation, for example, after the formation of the first annular groove. Therefore, production process becomes easier. (z10) The step portion includes a shoulder surface which is formed between the inner circumferential surface of the first annular groove (6) and the outside circumferential surface (15*b*) of the cylindrical portion (15), and which is arranged to receive a pressure in the first annular groove axially.

(z11) The inner circumferential surface of the first annular groove is equal in diameter to the inner circumferential surface of the second annular groove. (z12) The second portion of the step portion is arranged to regulate movement in a radial inward direction of the guide ring in the first annular groove. (z13) The first portion of the step portion includes an outside circumferential surface substantially equal in outside diameter to the outside circumferential surface of the cylindrical portion. In this case, the step portion can be formed simultaneously at the time of forming the outside circumferential surface of the cylindrical portion. (z14) The outside circumferential surface of the cylindrical portion is continuous with the inner circumferential surface of the first annular groove. In this case, the continuous outside circumference of the cylindrical portion having no step portion is advantageous for preventing stress concentration. (z15) The outside circumferential surface of the cylindrical portion and the inner circumferential surface of the first annular groove are formed continuously by a machining operation including at least one of a cutting operation and a grinding operation. (z16) The rotor includes a recess recessed radially inwards from an inner circumferential surface of the first annular groove. In the illustrated example, the recess is recessed radially inwards beyond the outside circumferential surface of the cylindrical portion. In this case, it is possible to ensure the sufficient pressure receiving area without increasing the outside diameter of the rotor. Moreover, by increasing the area of the outside circumferential surface of the cylindrical portion, it is possible to increase the radial seal area and to improve the sealing performance.

(z17) The vane pump further comprises: a first urging member to urge the cam ring in a direction to increase an eccentricity of the cam ring with respect to a rotation center of the rotor; and a second urging member to urge the cam ring in a direction to decrease the eccentricity of the cam ring with an urging force smaller than an urging force of the first urging member in a state in which the eccentricity of the cam ring is greater than or equal to a predetermined level, and to store the urging force of the second urging member without applying the urging force of the second urging member to the cam ring in a state in which the eccentricity of the cam ring is smaller than the predetermined level. (z18) The vane pump further comprises: a pivot pin provided between an outside circumferential surface of the cam ring and an inside circumferential surface of the housing and arranged to serve as a fulcrum for a swing motion of the cam ring; an urging member to urge the cam ring in a direction to increase an eccentricity of the cam ring with respect to a rotation center of the rotor; a first control pressure chamber formed between the outside circumference surface of the cam ring and the inside circumferential surface of the housing, and arranged to swing the cam ring with an oil pressure introduced into the first control pressure chamber, against the urging force of the urging member; a second control pressure chamber arranged to swing the cam ring with an oil pressure introduced into the second control pressure chamber, in a direction of the urging force of the urging member; and a solenoid selector valve to control supply and discharge of a discharge pressure to the first control pressure chamber and the second control pressure chamber. (z19) The vane pump further comprises a control unit to control the solenoid selector valve in accordance with a parameter including at least one of an engine temperature, an engine load and an engine speed of an internal combustion engine. (z20) The drive shaft includes an engagement shaft portion having a noncircular cross section, and the rotor includes an engagement hole having a noncircular cross section and engaging with the engagement shaft portion of the drive shaft (through a slight clearance). (z21) The engagement shaft portion of the drive shaft has two opposite flat (parallel) outside surfaces, and the engagement hole of the rotor has two opposite flat (parallel) inside surfaces. (z22) The vane pump is provided in a balancer device of an internal combustion engine, and the drive shaft is an extension of a balancer shaft of the balancer device. In this case, the drive shaft and the balancer shaft can be formed as a single unit, so that the number of component parts can be reduced. (z23) The sliding contact area between the slide contact portion of the rotor and the inside wall surface of the second side wall of the housing is smaller than the sliding contact area between the outside circumferential surface of the cylindrical portion of the rotor and the inside circumferential surface of the first through or bearing hole of the first side wall of the housing. (z24) The housing includes a housing member and a pump cover defining the inside chamber, the housing member is formed with the first through hole receiving the cylindrical portion of the rotor and the pump cover is formed with the second through hole receiving the drive shaft (with a slight clearance). The first through hole is arranged to receive the cylindrical portion of the rotor and to form a large sliding contact area between the outside circumferential surface of the cylindrical portion and the inside circumferential surface of the first through hole. Therefore, it is possible to improve the accuracy of the position at the time of assembly operation.

This application is based on a prior Japanese Patent Application No. 2013-218028 filed on Oct. 21, 2013. The entire contents of this Japanese Patent Application are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

The invention claimed is:

1. A vane pump comprising:

a housing including first and second side walls confronting each other and having therein an inside chamber to receive a pump element;

a drive shaft which extends in an axial direction and which is received rotatably in first and second through holes formed, respectively, in the first and second side walls of the housing;

a rotor mounted on the drive shaft and arranged to be driven rotationally by the drive shaft, and to serve as at least part of the pump element, the rotor including a first annular groove formed in a first axial end surface of the rotor, and a second annular groove formed in a second axial end surface of the rotor;

a plurality of vanes received, respectively, in a plurality of slits formed radially in an outer circumferential portion of the rotor and arranged to slide radially in the slits, respectively;

first and second guide rings received, respectively, in the first and second annular grooves and arranged to push the vanes radially outwards in the slits in accordance with rotation of the rotor;

the rotor including a cylindrical portion which is formed integrally on a radial inner side of the first annular groove, and which projects in the axial direction from the first axial end surface, along the drive shaft, and a slide contact portion formed on a radial inner side of the second annular groove in the second end surface;

an outside circumferential surface of the cylindrical portion of the rotor being slidably disposed in an inside circumferential surface of the first through hole of the first side wall of the housing, whereas the slide contact portion of the rotor includes a slide contact surface abutting slidably on an inside wall surface of the second side wall of the housing;

a pressure receiving area in the axial direction, of one of the first and second annular grooves being set greater than a pressure receiving area in the axial direction, of the other of the first and second annular grooves.

2. The vane pump as recited in claim 1, wherein the vane pump further comprises a cam ring which is received in the inside chamber of the housing, which includes an inside circumferential surface put in sliding contact with forward ends of the vanes, and which is arranged to swing in accordance with a pump discharge pressure and thereby to vary a volume of a pump chamber defined by the rotor and the vanes.

3. The vane pump as recited in claim 2, wherein the vane pump further comprises:

a first urging member to urge the cam ring in a direction to increase an eccentricity of the cam ring with respect to a rotation center of the rotor; and a second urging member to urge the cam ring in a direction to decrease the eccentricity of the cam ring with an urging force smaller than an urging force of the first urging member in a state in which the eccentricity of the cam ring is greater than or equal to a predetermined level, and to store the urging force without applying the urging force to the cam ring in a state in which the eccentricity of the cam ring is smaller than the predetermined level.

4. The vane pump as recited in claim 2, wherein the vane pump further comprises:

a pivot pin provided between an outside circumferential surface of the cam ring and an inside circumferential surface of the housing and arranged to serve as a fulcrum for a swing motion of the cam ring;

an urging member to urge the cam ring in a direction to increase an eccentricity of the cam ring with respect to a rotation center of the rotor;

a first control pressure chamber formed between the outside circumference surface of the cam ring and the inside circumferential surface of the housing, and arranged to swing the cam ring with an oil pressure introduced into the first control pressure chamber, against the urging force of the urging member;

a second control pressure chamber arranged to swing the cam ring with an oil pressure introduced into the second control pressure chamber, in a direction of the urging force of the urging member; and a solenoid selector valve to control supply and discharge of a discharge pressure to the first control pressure chamber and the second control pressure chamber.

5. The vane pump as recited in claim 4, wherein the solenoid selector valve is adapted to be controlled by a control unit in accordance with a parameter including at least one of an engine temperature, an engine load and an engine speed of an internal combustion engine.

6. The vane pump as recited in claim 1, wherein the rotor includes a step portion formed between an inner circumferential surface of the first annular groove and an outside circumferential surface of the cylindrical portion, and arranged to increase the pressure receiving area of the first annular groove.

7. The vane pump as recited in claim 6, wherein the step portion is formed by a first portion which is equal in diameter to the outside circumferential surface of the cylindrical portion and a second portion which forms the inner circumferential surface of the first annular groove and which is connected with the first portion in a form of a step.

8. The vane pump as recited in claim 7, wherein the inner circumferential surface of the first annular groove is equal in diameter to an inner circumferential surface of the second annular groove.

9. The vane pump as recited in claim 8, wherein the second portion of the step portion is arranged to regulate movement in a radial inward direction of the guide ring in the first annular groove.

10. The vane pump as recited in claim 9, wherein the first portion of the step portion includes an outside circumferential surface substantially equal in outside diameter to the outside circumferential surface of the cylindrical portion.

11. The vane pump as recited in claim 1, wherein an outside circumferential surface of the cylindrical portion is continuous with an inner circumferential surface of the first annular groove.

12. The vane pump as recited in claim 11, wherein the outside circumferential surface of the cylindrical portion and the inner circumferential surface of the first annular groove are formed continuously by a machining operation including at least one of a cutting operation and a grinding operation.

13. The vane pump as recited in claim 1, wherein the rotor includes a recess recessed radially inwards from an inner circumferential surface of the first annular groove, to a position on a radial inner side of the outside circumferential surface of the cylindrical portion.

14. The vane pump as recited in claim 1, wherein the drive shaft includes an engagement shaft portion having a noncircular cross section, and the rotor includes an engagement hole having a noncircular cross section and engaging with the engagement shaft portion of the drive shaft.

15. The vane pump as recited in claim 14, wherein the engagement shaft portion of the drive shaft has two opposite flat outside surfaces, and the engagement hole of the rotor has two opposite flat inside surfaces.

16. The vane pump as recited in claim 14, wherein the vane pump is provided in a balancer device of an internal combustion engine, and the drive shaft is an extension of a balancer shaft of the balancer device.

17. The vane pump as recited in claim 1, wherein a sliding contact area between the slide contact portion of the rotor and the inside wall surface of the second side wall of the housing is smaller than a sliding contact area between the outside circumferential surface of the cylindrical portion of the rotor and the inside circumferential surface of the first through hole of the first side wall of the housing.

18. The vane pump as recited in claim 1, wherein the housing includes a housing member and a pump cover defining the inside chamber, the housing member is formed with the first through hole receiving the cylindrical portion of the rotor and the pump cover is formed with the second through hole receiving the drive shaft.

19. A vane pump comprising:

a housing includes first and second side walls confronting each other axially;

a drive shaft received rotatably in first and second bearing holes formed, respectively, in the first and second side walls of the housing;

a rotor which is adapted to be driven by the drive shaft, and which includes a first annular groove formed in a first end surface confronting the first side wall of the housing axially, and a second annular groove formed in a second end surface confronting the second side wall of the housing axially;

a plurality of vanes received, respectively, in a plurality of slits formed radially in the rotor and arranged to slide radially in the slits, respectively;

first and second guide rings received, respectively, in the first and second annular grooves and arranged to push the vanes radially outwards in the slits in accordance with rotation of the rotor;

the rotor including a cylindrical portion which projects from the first end surface, on a radial inner side of the first annular groove, which fits over the drive shaft, and which includes an outside circumferential surface set in sliding contact with an inside circumferential surface of the first bearing hole of the first side wall of the housing; and a slide contact portion which is formed on a radial inner side of the second annular groove in the second end surface, and which is in sliding contact with an inside wall surface of the second side wall of the housing;

the first annular groove including a first confronting surface confronting the first side wall of the housing axially and receiving a fluid pressure in the first annular groove axially, the second annular groove includes a second confronting surface confronting the second side wall of the housing axially and receiving a fluid pressure in the second annular groove axially, and one of the first and second annular grooves including a portion increasing a pressure receiving area of the confronting surface as compared to a pressure receiving area of the confronting surface of the other of the first and second annular grooves.

20. A vane pump comprising:

a housing includes first and second side walls confronting each other axially;

a drive shaft received rotatably in first and second bearing holes formed, respectively, in the first and second side walls of the housing;

a rotor which is mounted on the drive shaft and adapted to be driven by the drive shaft;

a plurality of vanes received, respectively, in a plurality of slits formed radially in the rotor and arranged to slide radially in the slits, respectively;

first and second guide rings received, respectively, in first and second guide ring receiving portions formed, respectively, in first and second end surfaces of the rotor and arranged to push the vanes radially outwards in the slits in accordance with rotation of the rotor;

the rotor including a cylindrical portion which projects from the first end surface, on a radial inner side of the first guide ring receiving portion, and which includes an outside circumferential surface set in sliding contact with an inside circumferential surface of the first bearing hole of the first side wall of the housing; and a slide contact portion which is formed on a radial inner side of the second guide ring receiving portion in the second end surface, and which includes an annular slide contract surface in sliding contact with an inside wall surface of the second side wall of the housing;

a pressure receiving area of one of the first and second guide ring receiving portions being set greater than a pressure receiving area of the other of the first and second guide ring receiving portions.

* * * * *